United States Patent [19]

Marchou

[11] 4,053,965

[45] Oct. 18, 1977

[54] TIGHTENING BAND

[76] Inventor: Jacques R. Marchou, 38 ter rue Saint-Hilaire, 94210 - La Varenne St. Hilaire, France

[21] Appl. No.: 689,827

[22] Filed: May 25, 1976

[30] Foreign Application Priority Data

June 10, 1975 France ..... 75.8082

[51] Int. Cl.[2] ..... B65D 63/02

[52] U.S. Cl. ..... 24/20 TT

[58] Field of Search ..... 24/20 R, 20 CW, 20 EE, 24/20 TT, 20 W, 22, 23 EE, 25

[56] References Cited

U.S. PATENT DOCUMENTS

| | | | |
|---|---|---|---|
| 712,765 | 11/1902 | Cole | 24/20 TT |
| 3,293,709 | 12/1966 | Holton | 24/20 TT |
| 3,429,605 | 2/1969 | Soesbergen | 24/20 TT |
| 3,475,793 | 11/1969 | Oetiker | 24/20 CW |
| 3,491,411 | 1/1970 | Basson | 24/20 TT |

*Primary Examiner*—George H. Krizmanich
*Attorney, Agent, or Firm*—Lewis H. Eslinger

[57] ABSTRACT

Fastening member of the tightening band type constituted by a tape whose two ends comprise complementary attachment means, each of the ends comprising on the other hand a prehension means enabling the tightening and cooperation of the fastening means with the aid of a suitable tool in the form of pliers, one of the ends of the tape having at least one zone of smaller transverse section constituting a zone of least resistance.

6 Claims, 3 Drawing Figures

Figures 1, 2, 3:
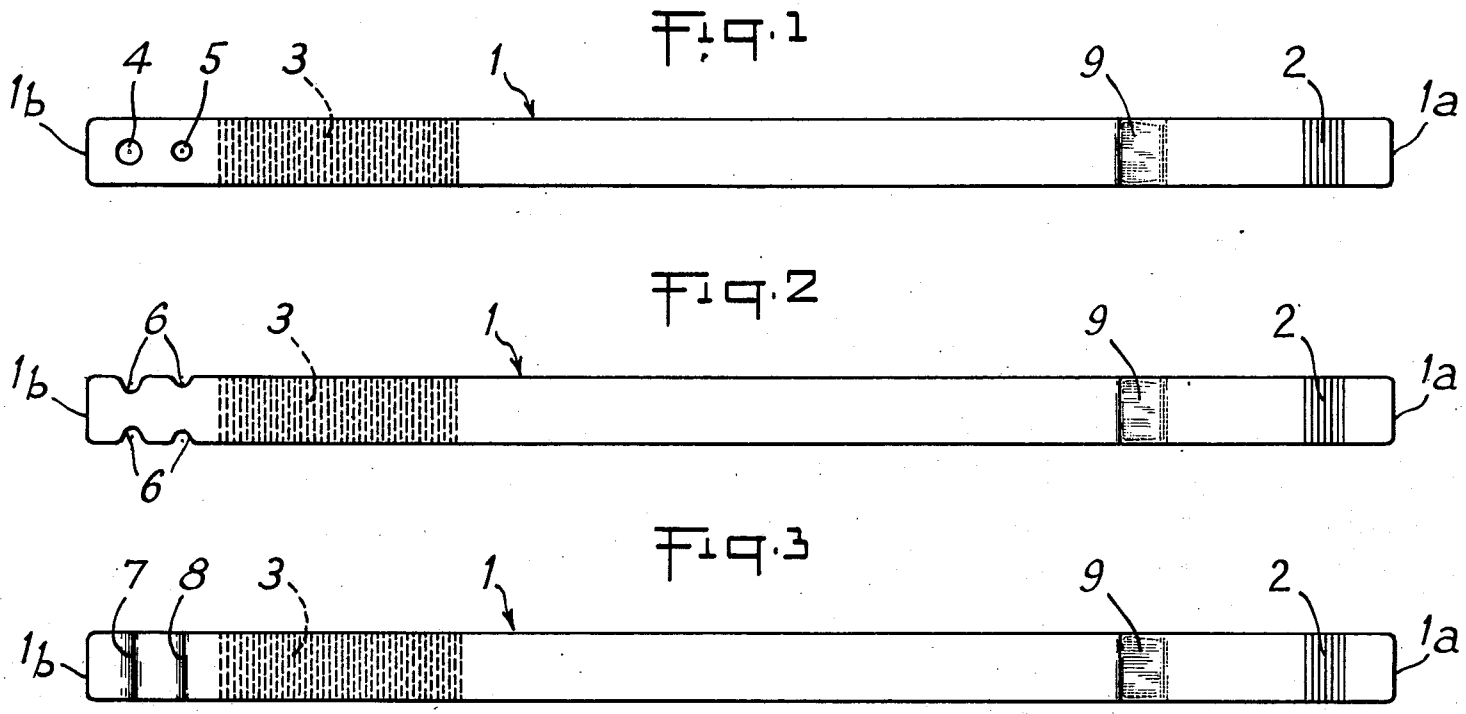

1a
2
9
1
3
5
4
1b 1a
2
9
1
3
6
6
1b 1a
2
9
1
3
8
7
1b

TIGHTENING BAND

The present invention relates to a fastening member of the tightening band type.

Numerous types of tightening bands are already known, which are used in particular in the manufacture of electrical household apparatus or in the automobile industry, for example for ensuring the tight connection of two pipes, of which one is made of supple material. Bands are known in particular which are constituted by a tape element made of supple material, e.g. metal, wound on itself. The ends of such a band have at least on their opposite faces complementary attachment means, for example suitably orientated teeth. These ends are generally maintained in contact with each other by a clip or the like enabling the band to be maintained tightened.

This type of fastening member is generally placed in position by means of special pliers or the like whose jaws cooperate with prehension means provided on the band near its ends, or more simply pull on the non-covered end of the band after it has been wound, whilst preventing it from sliding on the object to be tightened, by any suitable means.

However, the known bands do not make it possible to tighten with the necessary accuracy, nor, in particular, rapidly and easily to apply a determined tightening, as appears useful especially in automobile construction.

It is therefore an object of the present invention to provide an improved fastening member, of the tightening band type, comprising means enabling a tightening to be effected simply and rapidly with a determined force, this result being visible simply by examining the band. The expression "visualization of the strain" employed hereinafter indicates the purpose of the invention.

In accordance with the invention, one of the ends of the band has at least one zone of smaller transverse section constituting a zone of least resistance. Of course, the end of the band thus provided will be the one intended to be located above the band after it has been wound around the object to be tightened.

The zone of smaller transverse section may be produced in numerous ways, for example by means of central or side apertures or notches made in the band or by a local reduction in the thickness, the width of the band preferably being maintained constant, at least in the latter case.

No complicated tool is required for carrying out the invention, either for its manufacture or use. In particular, the known manufacture of the tightening bands by die stamping or like method is suitable for carrying out the invention. As regards the tightening tool, it suffices that it comprises, as is known, means for cooperating with the ends of the band.

The invention will be more readily understood on reading the following description with reference to the accompanying drawings, in which:

FIG. 1, 2 and 3 show plan views of three variant embodiments of tightening bands in accordance with the invention.

Referring now to the drawings, the Figures show a band which is essentially constituted by a flat tape 1, for example made of metal, of constant width. Each of its ends 1*a* and 1*b* has toothed zones 2 and 3 intended for cooperation with each other after the tape has been wound on the object to be tightened. If necessary, the teeth are held in mesh by a clip or the like (not shown) generally placed in position before tightening.

Behind the toothed zone 2, with respect to the corresponding end 1*a*, there is provided at least one rough surface 9, for example stamped, constituting a point of support for one of the jaws of a tightening tool such as, for example, the pliers like tool shown in U.S. Pat. No. 3,293,709. The other jaw will cooperate with the end 1*b* corresponding to the toothed zone 3 under conditions which will be described hereinbelow.

Between the end 1*b* and the toothed zone 3 which is located on the visible surface of tape 1, there is provided a plane part constituting an element that may be gripped by the tightening tool.

To this end, in the embodiment according to FIG. 1, there are provided two holes 4 and 5, hole 5 preferably being somewhat smaller than hole 4. A finger provided on one of the jaws of the tightening tool is inserted into the hole 4 and thus enables the end 1*b* to be gripped.

During tightening, the teeth of the two zones 2 and 3 mesh successively into one another. When the tightening force exerted by the tool becomes too great, the mechanical resistance of the tape near the hole 4 becomes insufficient to withstand it. The tape then tears at the hole 4, which allows the finger of the tool to escape. The positioning of the band is terminated and it remains in its tightened position by cooperation of the teeth of zones 2 and 3.

The dimensions and position of the hole 4 are, of course, determined as a function of the desired degree of tightening. On the other hand, the observation of the tear at the hole 4 shows that the band has been tightened with the desired force.

The existence of the second hole 5 enables the tightening operation to be restarted, if necessary, for example after a certain period of use of the tightened member. This arrangement is particulalry useful in the case of tightening flexible pipes conveying fluids under pressure.

In the embodiment of FIG. 2, the zone of smaller section is formed by means of at least one notch 6, and preferably two, disposed opposite each other, on the side edges of the band. There again, it will be advantageous if two successive zones of least resistance are provided, the second preferably having a resistance greater than the first.

The "visualization of the strain" is obtained in a manner similar to that described hereinabove, by rupture of the band at the level of the first, then, if necessary, of the second zone of least resistance. Of course, in this case, the tightening tool is suitably shaped as to grip the end 1*b* of the band.

In the embodiment of FIG. 3, the zone of smaller section is produced by a reduction in the thickness of the band, for example along a line 7 or two lines 7 and 8. The width of the band will preferably be constant, but the reduced thickness may be judicisouly combined with any width to obtain a zone of least resistance. However, the resistance of line 8 will preferably be greater than that of line 7.

The "visualization of the strain" is obtained similarly to the manner described hereinabove.

Of course, it is obvious that the different means of visualizing the strain described hereinabove may be combined with one another and, in certain particular cases, more than two successive lines of least resistance may be provided.

It is also obvious that the invention is not limited to the means described for effecting fastening of the two ends of the band but covers on the contrary all the possible cases of application of the visualization of the strain.

What is claimed is:

1. A fastening member of the tightening band type comprising an elongated tape having opposed first and second end portions and a generally uniform transverse cross-sectional area between said end portions except at said first end portion whereby said tape has substantially the same strength to resist stress all along its length, said first and second end portions including free ends and having complementary cooperating attachment means formed thereon inwardly of said free ends for holding said end portions together in any of a plurality of relative positions, said first and second end portions each also including prehension means for cooperating with a tightening tool to enable said first and second end portions to be moved with respect to each other in adjacent relation thereby to engage said cooperating attachment means in a desired relative position, said first end portion of the tape having at least one zone of smaller cross-sectional area than the remainder of the tape defining a zone of least resistance whose strength to resist stress is less than that of the remainder of the tape and being located between the attachment means and the prehension means of said first end portion of the tape.

2. A fastening member as claimed in claim 1, wherein the zone of smaller smaller cross-sectional area comprises a hole made in the tape.

3. A fastening member as claimed in claim 1 wherein the zone of smaller cross-sectional area comprises at least one notch formed on one of the side edges of said first end portion of the tape.

4. A fastening member as claimed in claim 1, wherein the zone of smaller cross-sectional area comprises a section of said tape in said first end portion having reduced thickness over at least a part of the width of the tape.

5. A fastening member as claimed in claim 1, wherein said zone of smaller cross-sectional area comprises two successive spaced sections of smaller cross-sectional area in said first end portion of the tape with the section which is further away from the free end of the first end portion of the tape having a cross-sectional area which is greater than the cross-sectional area of the section which is closer to said free end but less than the cross-sectional area of the remainder of the tape.

6. A fastening member of the tightening band type comprising an elongated tape having opposed first and second end portions and a substantially uniform width and thickness along its entire length except at a predetermined zone in said first end portion whereby said tape has substantially the same strength to resist stress all along its length except at said zone, said first and second end portions including free ends and having complementary cooperating attachment means formed thereon inwardly of said free ends for holding said end portions together in any of a plurality of relative positions, said first and second end portions each also including prehension means for cooperating with a tightening tool to enable said first and second end portions to be moved with respect to each other in adjacent relation thereby to engage said cooperating attachment means in a desired relative position, said first end portion of the tape at said zone being smaller in at least one of its width and thickness dimensions than the remainder of the tape to define a zone of least resistance whose strength to resist stress is less than that of the remainder of the tape, said zone being located between the attachment means and the prehension means of said first end portion of the tape.

* * * * *